United States Patent [19]

Munoz et al.

[11] Patent Number: 5,025,525

[45] Date of Patent: Jun. 25, 1991

[54] TOOTH BRUSH WITH AN ANATOMICALLY COMPATIBLE STRUCTURE

[76] Inventors: Jose R. Munoz; Maria O. Laporta, both of Francisco Alegre, 31, 08024 Barcelona, Spain

[21] Appl. No.: 478,270

[22] Filed: Feb. 9, 1990

[30] Foreign Application Priority Data

Feb. 23, 1989 [ES] Spain ..... 8900577
Dec. 5, 1989 [ES] Spain ..... 8903685

[51] Int. Cl.[5] ..... A46B 9/04

[52] U.S. Cl. ..... 15/167.1; 15/143 R; D4/104; D4/138

[58] Field of Search ..... 15/167.1-167.3, 15/143 R, 106, 110, 186-188, 159 R, 160, 159 A, DIG. 5, 201, 144 R; D4/104-113, 127-138, 199; D24/10, 11; 16/110 R; 81/489

[56] References Cited

U.S. PATENT DOCUMENTS

| | | | |
|---|---|---|---|
| D. 190,073 | 4/1961 | Schwartz | D4/112 |
| D. 285,263 | 8/1986 | Hill | D4/104 |
| 1,657,450 | 1/1928 | Barnes | 15/143 R X |
| 2,094,240 | 9/1937 | Herrick et al. | 15/143 R X |
| 2,253,210 | 8/1941 | Psiharis | 15/167.1 X |
| 2,304,319 | 12/1942 | Saltzman | D4/104 X |
| 2,360,745 | 10/1944 | Vogel | 15/167.1 |
| 4,351,080 | 9/1982 | Grossman | 15/143 R X |
| 4,519,109 | 5/1985 | Raymond | 15/110 |
| 4,524,478 | 6/1985 | Ross | 15/167.1 X |

*Primary Examiner*—Philip R. Coe
*Assistant Examiner*—C. E. Cooley
*Attorney, Agent, or Firm*—Michael J. Striker

[57] ABSTRACT

The tooth brush having an anatomically compatible structure has a handle which is twisted in comparison to that of the conventional tooth brush so that a plane passing through the head of the tooth brush bearing the bristles and another plane passing through the handle cross each other at a certain angle. The handle is however preferably divided into two parts, a concavo-convex oblong section contiguous to the neck inclined with respect to the plane of the head and a rhombus-like cross sectioned end part which is also inclined with respect to the plane of the head, but in the opposite direction to that of the oblong section. The handle can be provided with a depression and shaped to fit the thumb and forefinger when gripped by the hand. Because of the structure of tooth brush, the bristles can be applied upright on the teeth, when the hand holds the handle in a more comfortable unstrained position than the conventional tooth brush.

5 Claims, 2 Drawing Sheets

TOOTH BRUSH WITH AN ANATOMICALLY COMPATIBLE STRUCTURE

BACKGROUND OF THE INVENTION

The present invention relates to a tooth brush having an anatomical structure which is compatible with the user's hand and provides a good contact of the bristles with the teeth. This new tooth brush is particularly easily workable because of the orientation of the planes that pass through the head and handle of the tooth brush.

With the conventional tooth brush having a handle and a head with bristles it is difficult to achieve a complete total cleaning of the teeth. Usual brushes are uncomfortable to handle because of the way the handle is shaped with respect to the bristles. With the current tooth brushes it is impossible to attain a good position to carry out, in a satisfactory way, the cleaning of the teeth in the way that the odontologists recommend.

SUMMARY OF THE INVENTION

It is an object of the present invention to provide an improved tooth brush with an anatomically compatible structure which has none of the above-mentioned disadvantages.

It is also an object of the present invention to provide an improved tooth brush with an anatomically compatible structure which makes it possible to carry out the cleaning of the teeth in a way which is particularly recommended by odontologists.

According to our invention the tooth brush includes a head bearing a plurality of bristles and a handle which are connected to each other and structured so that the bristles always remain essentially perpendicular(upright) to the external side of the teeth, although the brush is held in the user's hand in a comfortable position. More particularly the tooth brush according to this embodiment comprises a head which has a thickness which is substantially smaller than its other two dimensions, i.e. its width and length, and which has a substantially planar face on which the bristles are affixed. A plane passing through the head of the tooth brush parallel to the planar face of the tooth brush is what is meant by the head plane. The handle portion similarly has a thickness which is smaller than its other two dimensions and which has a plane bisecting its thickness, which is referred to hereinafter as "the plane of the handle". In the simplest conception of our invention the head plane is not parallel or coplanar with the plane of the handle as it is in the conventional tooth brush but instead is inclined at a certain angle to the plane of the handle so that the plane of the handle and the plane of the head intersect. Thus the bristles of the brush engage the external side of the teeth when being cleaned without requiring the hand to be uncomfortably positioned when the tooth brush is being used.

In another embodiment of our invention the handle is connected to the head of the tooth brush by a neck and is divided into two different parts. One part of the handle is contiguous to the neck and is an oblong concavo-convex section which is inclined with respect to the plane of the head. The other part of the handle has a rhombus-like cross section and is also inclined to the plane of the head, but in the opposite direction to that of the first part. The first oblong concavo-convex section is designed to fit the thumb and the forefinger, while the other part which has the lozenge-like cross section remains gripped between the palm of the hand and the rest of the user's fingers.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE INVENTION

Figure 1:
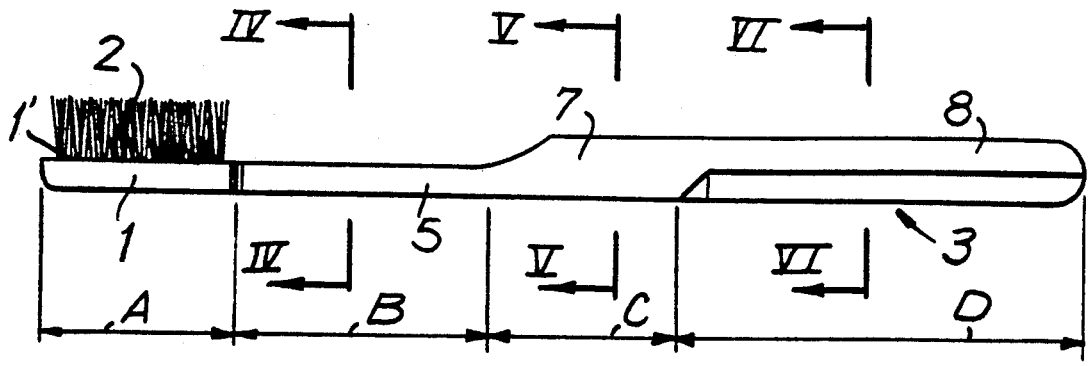
FIG. 1 is a side elevational view of one embodiment of a tooth brush according to our invention.

FIGS. 1 to 7 show an embodiment of the tooth brush of our invention. In this embodiment the tooth brush has a single-unit construction and is made of variable material. This tooth brush is divided into the following sections or parts: (A) a head 1 with a plurality of bristles 2, (B) a neck 5, (C) a first part(oblong concavo-convex section) 7 of the handle 3 and (D) a second or end part 8 of the handle 3. In the embodiment shown in FIG. 1 in which the tooth brush is linear or straight all the parts 1, 5, 7 and 8 are arranged in a line, but in the example of FIGS. 2 and 3 the handle 7,8 and the head 1 are in different planes. This means that the bristles 2 may be lower than the handle as in the embodiment of FIG. 2 or higher than the handle as in the embodiment of FIG. 3. These differences do not change the essential operation of this embodiment of the invention.

Figure 6:
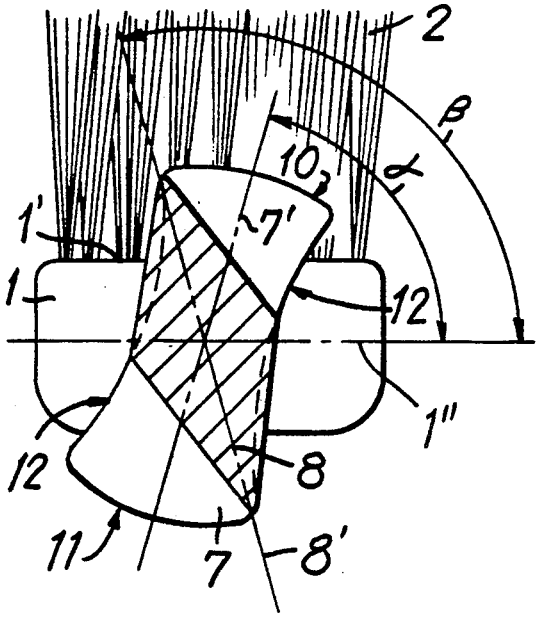
FIG. 6 is a cross sectional view of the tooth brushes shown in FIGS. 1 to 3 taken along the section line VI—VI of FIGS. 1 to 3.
Figure 7:
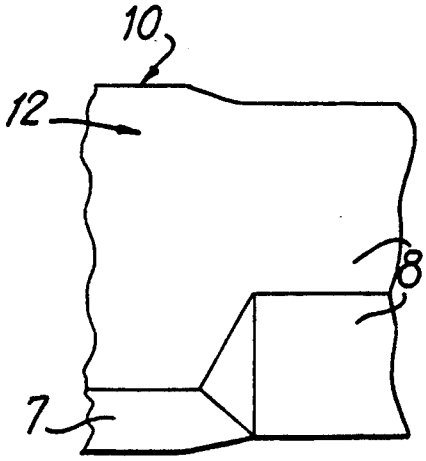
FIG. 7 is a detailed cross sectional view of an embodiment of the tooth brush in which the handle is made of two parts showing the junction between the two parts of the handle.

When examining FIG. 6 looking at the brush end on, the part 7 is inclined with respect to the plane 1" of the head 1 and forms an acute angle with it. This same part 7, which is an oblong concavo-convex section, has two convex end sides 10 and 11, of which the first one 10 (lined-up with the bristles 2) is less wide than the opposite one 11 (directed to the back of the head 1). Both remaining sides or faces of this part have a concavity or concave portion 12. A difference of width of the sides 10 and 11 is shown with the arc length (a) and (b). The end part 8 has a approximately rhombus-like cross section and the largest diagonal axis 8' of this end part cross section makes an obtuse angle B relative to the planar surface 1" of the head 1 having the bristles 2. The acute vertices 14 of this approximately rhombus-like cross sectioned end part 8 coincide with two diagonally opposite vertices 15 of the part 7, while the obtuse vertices 16 coincide with the opposing concave faces 12. Thus the two parts 7 and 8 of the handle 3 provide an evenness of surface that results in an optimum contact, comfortable and effective, between this brush and the hand.

Figure 2:
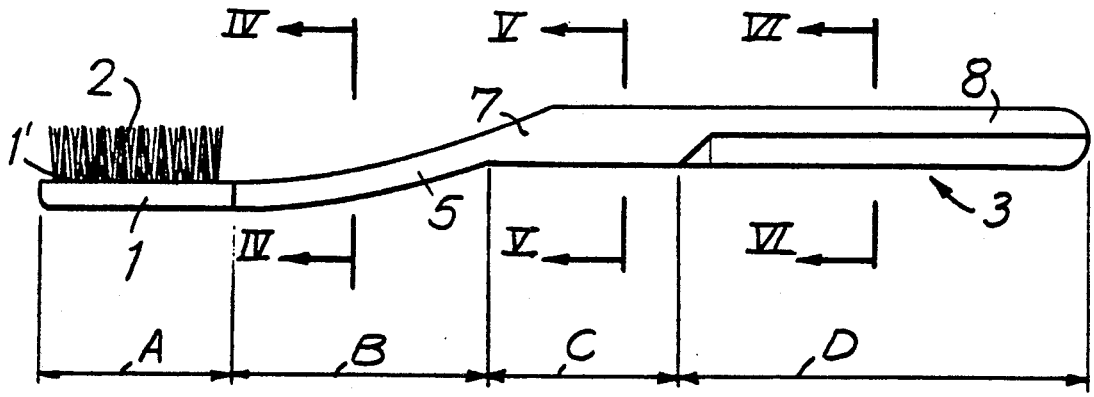
FIGS. 2 and 3 are side elevational views of other embodiments of the tooth brush shown in FIG. 1.
Figure 3:
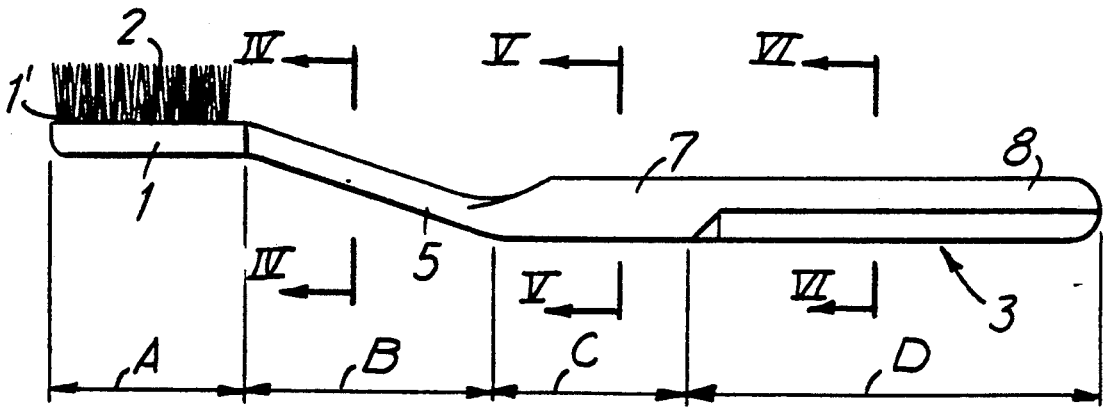
Figure 4:
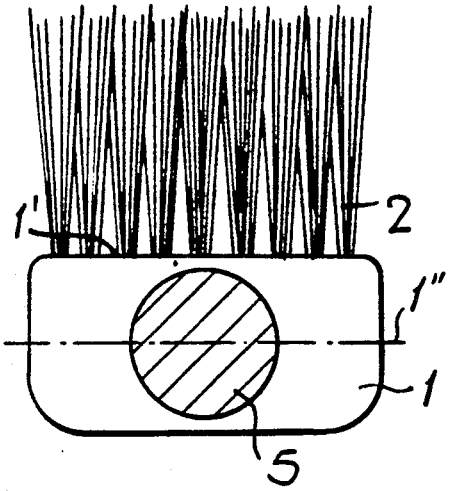
FIG. 4 is a cross sectional view of the tooth brushes shown in FIGS. 1 to 3 taken along the section line IV—IV of FIGS. 1 to 3.
Figure 5:
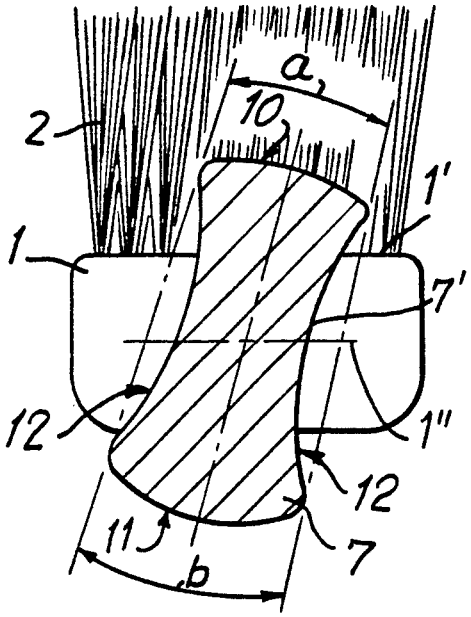
FIG. 5 is a cross sectional view of the tooth brushes shown in FIGS. 1 to 3 taken along the section line V—V of FIGS. 1 to 3.

As can be seen from an examination of FIG. 6 the anatomically-compatible brush of our invention is characterized by three planes, one of which 1″ is parallel to the planar surface 1′ bearing the bristles 2, another plane containing the center line 7′ of the oblong concavo-convex section (part 7) inclined at an acute angle $\alpha$ to the planar surface 1″ and a last plane including the largest diagonal axis 8′ of the part 8 which is inclined to the planar surface 1″, in a direction which is opposite to the other plane containing the center line 7′. The two planes of different orientation which the handle of the brush has are of essential importance in allowing the user to apply the thumb and forefinger on the two concave faces 12 of the part 7. It is easy to hold the handle 3 structured in this way so that the internal or external surfaces of the teeth can be cleaned whatever the direction of the rubbing is. The neck 5 can have any cross sectional area shape(circular, oval or other), because this does not affect the behavior of the handle 7,8 with respect to the bristles 2. In addition the neck 5 can be located between two planes at the same level as at a different one (FIGS. 2 and 3).

A plurality of protrusions 6 can be provided on the side of the head 1 not having the bristles 2. These protrusions 6 act as warning means that indicate that the brush is to be moved uprightly, i.e. up and down along the teeth. The protrusions are shown in dotted on FIGS. 1 and 2. Alternatively, the protrusions 6, when passing through the inside of the mouth in the area of the cheeks, will indicate with their rubbing an unsuitable horizontal movement has occurred.

The characteristics or features of this more complicated embodiment of our invention can be summarized as follows:

a) The handle 3 is divided into two differently oriented and differently cross sectioned parts.

b) This difference of orientation with relation to the head bearing the bristles is essential to secure a perfect and easy retaining of the brush when it is used for cleaning the teeth.

c) The two mentioned parts 7, 8 of the handle are arranged so that there exists a continuous smooth surface that provides a good contact with the thumb and forefinger and with the remaining fingers and palm of the hand.

d) The thumb and forefinger come precisely to support themselves in the concave part of the handle contiguous to the bristles, while the palm and the rest of the fingers do so on the remaining portions of the handle.

e) Since the acute vertices of the rhombus-like cross sectioned part of the handle coincide or are level with the vertices and concave surfaces of the contiguous part, the surface of the handle does not offer any inconvenient protrusion overall. On the other hand, a convexity is present which provides a comfortable fit and good contact with the thumb and forefinger.

Our tooth brush overcomes all the above-mentioned problems of the brushes on the market which require that, during use, the tooth brush be oriented in positions in which the hand is in a forced, uncomfortable orientation. With our new tooth brush the up and down rubbing(which is the type recommended by the odontologists) can be attained in all areas of the teeth in an easy way with maximum effectiveness regardless of the level of these bristles with respect to the handle.

It will be understood that each of the elements described above, or two or more together, may also find a useful application in other types of structures differing from the types described above.

While the invention has been illustrated and described as embodied in a tooth brush with an anatomically compatible structure, it is not intended to be limited to the details, shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An anatomically compatible tooth brush comprising a head having a plurality of bristles and a head plane, a neck and a handle connected to the head by the neck, said handle comprising an oblong concavo-convex section contiguous to said neck inclined with respect to said head plane and a substantially rhombus-like cross sectioned end part, said oblong concavo-convex section being designed to fit a thumb and forefinger of a hand of an individual, while said substantially rhombus-like cross sectioned end part is easily gripped by said hand in a comfortable position, when said bristles engage and remain upright on teeth of said individual.

2. An anatomically compatible tooth brush according to claim 1, further comprising a plurality of warning protusions attached on a side of said head not having said bristles to indicate improper motion of said bristles.

3. An anatomically compatible tooth brush according to claim 1, wherein said oblong concavo-convex section has two opposing concave faces and two convex end sides of different width, the end side having the smaller width being directed toward a side of the head bearing said bristles while the other end side being directed toward a side of the head not bearing said bristles, the opposing concave faces being shaped to fit the thumb and forefinger.

4. An anatomically compatible tooth brush according to claim 3, wherein said substantially rhombus-like cross sectioned end part has two opposing acute vertices which are coincident with two opposing vertices of said oblong concavo-convex section and two other obtuse vertices which are coincident with the concave faces of said oblong concavo-convex section so as to provide an even contact for the forefinger and other fingers and palm of the hand.

5. An antomically compatible tooth brush according to claim 4, wherein a plane containing a center line of the oblong concavo-convex section passes through the oblong concavo-convex section and makes an acute angle with the head plane, while another plane containing a larger diagonal axis of the substantially rhombus-like end part passes through the substantially rhombus-like end part and is oriented at an obtuse angle to the head plane.

* * * * *